US010100538B2

(12) United States Patent
Klehr et al.

(10) Patent No.: US 10,100,538 B2
(45) Date of Patent: Oct. 16, 2018

(54) DECK FOR A SHORING TOWER

(71) Applicant: Hünnebeck GmbH, Ratingen (DE)

(72) Inventors: Volker Klehr, Viersen (DE); Michael Becker, Voerde (DE); Jonas Fenner, Mülheim (DE)

(73) Assignee: Hunnebeck GmbH, Ratingen (DE)

( * ) Notice: Subject to any disclaimer, the term of this patent is extended or adjusted under 35 U.S.C. 154(b) by 0 days.

(21) Appl. No.: 14/926,491

(22) Filed: Oct. 29, 2015

(65) Prior Publication Data

US 2016/0123024 A1 May 5, 2016

(30) Foreign Application Priority Data

Oct. 31, 2014 (DE) ..... 10 2014 222 248

(51) Int. Cl.

| | |
|---|---|
| ***E04G 7/34*** | (2006.01) |
| ***E04G 1/00*** | (2006.01) |
| ***E04G 1/14*** | (2006.01) |
| ***E04G 1/15*** | (2006.01) |
| ***E04G 5/08*** | (2006.01) |

(Continued)

(52) U.S. Cl.

CPC ..... *E04G 7/34* (2013.01); *E04G 1/00* (2013.01); *E04G 1/14* (2013.01); *E04G 1/15* (2013.01); *E04G 5/08* (2013.01); *E04G 7/28* (2013.01); *E04G 11/48* (2013.01)

(58) Field of Classification Search

CPC ..... E04G 7/34; E04G 7/28; E04G 5/08

See application file for complete search history.

(56) References Cited

U.S. PATENT DOCUMENTS

| | | | | |
|---|---|---|---|---|
| 711,384 A | | 10/1902 | Carman | |
| 2,411,856 A | * | 12/1946 | Harding | A22B 5/06 211/118 |
| 2,656,223 A | | 10/1953 | Gray | |

(Continued)

FOREIGN PATENT DOCUMENTS

| | | | | |
|---|---|---|---|---|
| DE | 466549 C | * | 10/1928 | E04G 3/22 |
| DE | 30 14 212 A1 | | 10/1981 | |

(Continued)

OTHER PUBLICATIONS

Extended European Search Report, European Application No. 15191574.1-1601, dated Mar. 23, 2016, 7 pages.

PERI GmbH; Scaffolding Technology; Issue Feb. 2011; 6 pages.

*Primary Examiner* — Alvin C Chin-Shue

(74) *Attorney, Agent, or Firm* — Barnes & Thornburg LLP

(57) ABSTRACT

The invention concerns a deck (1) for forming an accessible area in a shoring tower (26), which can be used for fabrication or reconstruction of buildings, with a lifting lock (2) for avoiding take off of the deck (1) from an intended insertion position, preferably with two insertion hooks (2) each on both front sides, characterized in that the lifting lock (2) can also at a resting deck (1) switch from a detached position into a locked position only by force of gravity and/or the lifting lock (2) can switch from the locked position into the detached position by lifting the deck (1) through engaging at the lifting lock (2). Furthermore, a further developed system comprising a separate lifting and holding tool and a deck as well as a further developed shoring tower are disclosed. A very easy and safe assembly and disassembly can thereby be achieved.

19 Claims, 4 Drawing Sheets

Figure 1:
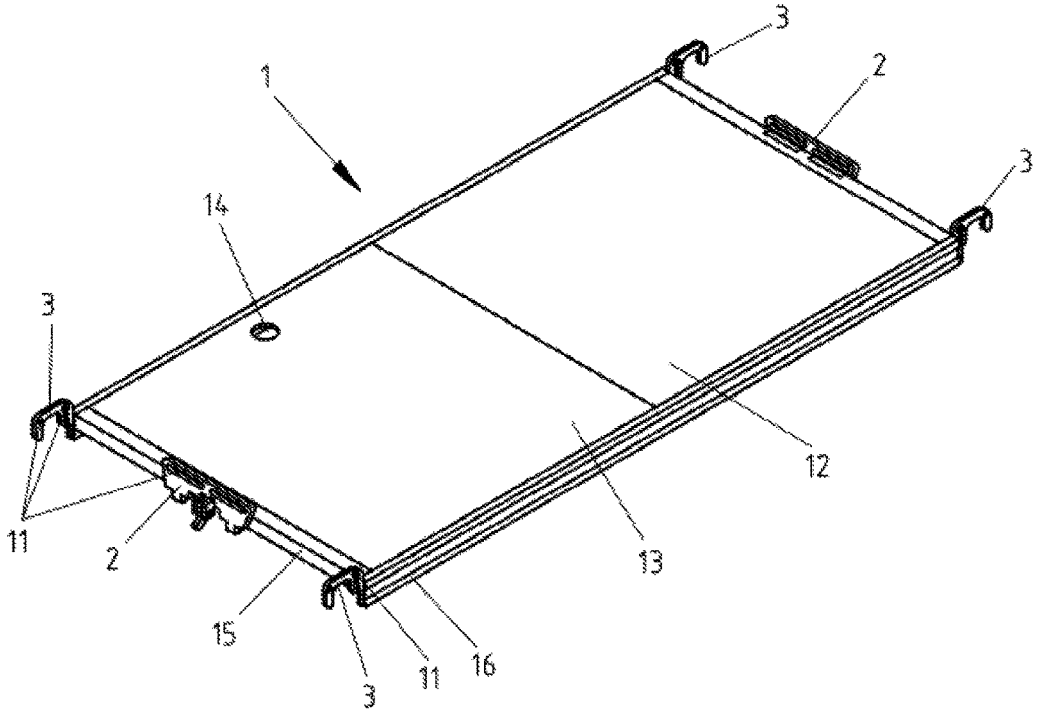

(51) Int. Cl.
*E04G 7/28* (2006.01)
*E04G 11/48* (2006.01)

(56) References Cited

U.S. PATENT DOCUMENTS

| | | | | |
|---|---|---|---|---|
| 2,830,840 | A * | 4/1958 | Johnson | A22B 7/002 104/97 |
| 2006/0175130 | A1* | 8/2006 | Riley | E04G 3/20 182/82 |
| 2009/0178885 | A1* | 7/2009 | Heath | E04G 1/14 182/119 |

FOREIGN PATENT DOCUMENTS

| | | | | |
|---|---|---|---|---|
| DE | 9417773 | U1 | 1/1995 | |
| DE | 44 21 069 | A1 | 12/1995 | |
| DE | 694 00 159 | T2 | 10/1996 | |
| EP | 2557252 | | 2/2013 | |
| EP | 2557252 | A1 | 2/2013 | |
| EP | 2586932 | A1 * | 5/2013 | E04G 7/304 |
| FR | 2859745 | | 3/2005 | |
| FR | 2859745 | A1 * | 3/2005 | E04G 1/15 |
| GB | 2127086 | A | 4/1984 | |
| GB | 2184192 | A | 6/1987 | |
| WO | 00/61891 | A1 | 10/2000 | |

* cited by examiner

DECK FOR A SHORING TOWER

This application claims priority to German Patent Application No. 102014222248.6, which was filed on Oct. 31, 2014, the disclosure of which is now expressly incorporated herein by reference.

The invention concerns a deck, a system comprising a separate lifting and holding tool and a deck, as well as a shoring tower.

Shoring towers can be used depending on design and load bearing capacity as working or protection scaffold for providing a work platform for workers for example at buildings as well as load-bearing scaffold or support frame for shoring beams for building a variable supporting structure for buildings, bridges or other constructions.

For erection of a shoring tower, a shoring of interconnected rods, struts, sticks and/or pipe profiles are assembled level by level until the needed height is reached. In periodical distances, commonly accessible areas or platforms are generated by means of decks mounted in the shoring, which serve for the assembly and disassembly of the shoring tower itself as well as a working platform for work on an adjoining building at for example a facade scaffold.

Shoring towers can have heights in which sometimes appear such strong gusts of wind that can detach or take off decks. This does not only cause a high risk of injury due to falling down decks, but also increased effort during assembly and disassembly.

The mounting of decks is often accomplished through over head assembly that increases the stress for the assembly operators. If a lifting lock is provided, this usually requires an increased effort during assembly and/or disassembly.

The document EP2557252A1 discloses an assembly deck and method for safe erection of a lead bearing scaffold tower. Spring pre-leaded hooks (see paragraph [0026]) at scaffold bars 20, 21 as well as noses 40 (see paragraph [0039]) are therein proposed for securing take off, wherein the scaffold bars 20, 21, which are mounted via articulated joints on a deck element 12, shall at the same time simplify the assembly (see paragraph [0034]).

The document FR2859745A1 discloses a plate 2 for a scaffold 2 with pivotable hooks 12 for hooking the plate 2 in a ladder 8. The pivotable hooks 12 are provided connected to the plate 2 through a pivotable horizontal bar 11 forming an articulated joint with the plate, thus not separate. A temporary hooking in of the plate 2 in the ladder 8 can be achieved.

The above mentioned features known from the state of the art can be combined alone or in various combinations with one of the following described subject matters according to the invention.

It is an objective of the invention to provide a further developed deck and shoring tower.

As solution for the problem serves a deck according to the main claim, a system comprising a separate lifting and holding tool and a deck as well as a shoring tower according to the independent claims. Preferred embodiments results from the dependent claims.

As solution serves a deck for forming an accessible area (platform) in a shoring tower, which can be used for fabrication or reconstruction of buildings, with a lifting lock for avoiding take off of the deck from an intended insertion position, preferably with two insertion hooks each on both front sides, wherein the lifting lock can also at a resting deck fall respectively switch from a detached position into a locked position only by force of gravity and/or the lifting lock can switch from the locked position into the detached position by lifting the deck through engaging at the lifting lock.

"Also at a resting deck" means that a switch into a locked position can also occur when the deck for example remains motionless in the intended insertion position, thus without a motion of the deck itself, but solely by force of gravity.

"Lifting the deck through engaging at the lifting lock" means that in this meant case, the lifting lock is used as grasp point (action point or lifting point) of the deck for lifting the deck.

As the lifting lock for avoiding undesired take off or lifting of the deck from an intended insertion position can switch only by means of forces of gravity from a detached position into a locked position and/or the lifting lock can switch from a locked position into a detached position by lifting the deck through the lifting lock, a deck with lifting lock can be provided with few production expenses, which can furthermore be assembled and dissembled in a very easy and quick manner.

Because along with insertion of the deck, a self-acting locking of the lifting lock is enabled at the same time. And by lifting of the deck through the lifting lock for assembly or disassembly, a self-acting unlocking of the lifting lock is enabled at the same time. This provides the prerequisites for enabling a very safe and easy assembly and disassembly particularly without process steps to be conducted overhead.

A lifting lock, which can fall by force of gravity from a detached position into a locked position, can also be locked and unlocked above or below the decks very easily by manual force. Furthermore, a very high safety against unwanted detaching of the deck particularly under lifting forces for example resulting from wind.

A deck can thereby be provided, which can be brought manually into the detached position from upside like downside for insertion respectively assembly or disassembly. At the same time, the prerequisite for usage of an lifting and holding tool can be achieved, which allow very fast and simple assembly or disassembly.

In one preferable embodiment, a deck is provided, wherein the lifting lock comprises a mass plate (bulk plate), which is translationally mounted by means of a vertical guide, preferably by means of a screw guided in an oblong hole.

Having a mass plate, which is translationally mounted, i.e. having only one degree of freedom and thus only movable along a vertical upwards or downwards, a lifting lock can be realized in a very simple way and with very few production expense, which can only by force of gravity fall from a detached position into a locked position and/or switch from a locked position into a detached position by means of lifting the deck through the lifting lock. The thereby achievable effects were described above.

In one preferable embodiment, the lifting lock comprises a catch for locking the deck with a horizontal shoring strut.

A catch (rotary latch) is a pivotable mounted latch, which allows fixation of a locking bolt or in this case a horizontal shoring strut.

By using a catch for locking the decks in the intended insertion position of the deck, an actuation respectively locking with very little frictional resistance can be enabled and thereby a lifting lock further developed, which can only by force of gravity fall from a detached position into a locked position and/or switch from a locked position into a detached position by means of lifting the deck through the lifting lock.

In one preferable embodiment, the catch of the lifting lock comprises an L-shaped latch, which preferably is pivoted (mounted) about a latch rotation axis that is oriented in parallel to a horizontal shoring strut.

L-shaped means that two latch arms with substantially similar length are connected under a roughly approximate right angle.

By means of an L-shaped latch, a catch can be realized very easily, space saving and weight saving as well as with very few production expense. Pivoted about a latch rotation axis that is in parallel to a horizontal shoring strut enables a fast and effective locking.

In one preferable embodiment, the latch rotation axis is arranged in an area or a turning area between an upper latch arm and a lower latch arm, wherein the upper latch arm and the lower latch arm confine an angle, which is particularly 70 degree to 110 degree, preferably 80 degree to 100 degree, preferred 85 degree to 95 degree.

Area between an upper latch arm and a lower latch arm refers to a larger section of the latch, which extends around the intersection point of both latch arms. The turning area is the section of the latch, which shows a curvature at the intersection point of both latch arms.

By providing a latch rotation axis in the area or in a turning area between both latch arms, a very low pivoting radius respectively required space for a pivoting motion of the turning areas about the latch rotation axis can be enabled and thereby a very compact design of the lifting lock being achieved.

By providing an angle between the upper and lower latch arm, particularly 70 degree to 110 degree, preferably 80 degree to 100 degree, preferred 85 degree to 95 degree, a very simple, space saving and simple to use lifting lock can be realized.

In one preferable embodiment, in locked position of the lifting lock, a lower latch arm protrudes for reaching (grasping or engaging) under a horizontal shoring strut for locking the lifting lock and/or a mass plate can be arranged planar adjacent (in direct contact) to an upper latch arm to block a rotation of the upper latch arm.

Having the lower latch arm hooking the horizontal shoring strut in locked position and/or the upper latch arm being arranged planar adjacent to a mass plate, a very reliable and robust locking can be enabled, which is furthermore very easy to lock and unlock.

In one preferable embodiment, a suspension for a latch or a catch, which is passed through by a latch rotation axis, is formed fork-shaped and/or provides a sliding surface for a mass plate.

By means of a fork-shaped suspension for a latch respectively a catch, a lifting lock can be provided very space saving and with little weight and at the same time the suspension can be used as a guide for a mass plate. By a suspension providing a sliding surface for a mass plate a very high safety, reliability and robustness of the lifting lock can be achieved during operations.

In one preferable embodiment, the lower latch arm is substantially as long as the upper latch arm.

Substantially as long means that a length difference of the lower latch arm and the upper latch arm is particularly at most 40 mm, preferably at most 30 mm, more preferred at most 20 mm and/or particularly at most ½ of the length of the longer latch arm, preferably ⅔, more preferred ¼ of the length of the longer latch arm.

Having the lower latch arm being substantially as long as the upper latch arm, it can be achieved firstly, that the lower latch arm pivots only by force of gravity downwards and insertion of the deck is enabled with simultaneous locking. Doing so, the center of mass of the latch can be displaced in a way that none of the latch arms protrude in detached position of the lifting device such that no cant (blocking) or getting stuck at the horizontal shoring strut during letting down respectively inserting of the deck can occur.

In one embodiment, the lower latch arm is longer than the upper latch arm. By means of a longer lower latch arm a very large surplus covering of the lower latch arm with the horizontal shoring strut and thus a very robust locking can be achieved.

In one embodiment, the upper latch arm is longer than the lower latch arm. This enables a targeted displacement of the point of mass.

In one preferable embodiment, the lifting lock provides a connection opening, particularly a hook-in-slot, for hooking in and/or hinged hooking in of a separate lifting and holding tool.

In contrast to the relatively wide meaning of hooking in, hinged hooking in makes clear that pivoting of components is enabled, which are connected by means of the hinged hooking in connection.

Through a connection opening, which allows hooking in or hinged hooking in of a separate lifting and holding tool, an advancing side protection can be realized very easily, overhead assembly can be avoided and a very easy and effortless assembly and disassembly is enabled. Furthermore, a very low weight of a deck can be achieved and a very easy transportation respectively handing over of a deck through openings in the shoring from the outside to the inside can be enabled.

In addition, the prerequisites are provided to enable insertion of a deck with simultaneous locking against taking off as well as lifting with simultaneous unlocking of the deck.

Thereby, a deck level can be completed and elevated upwards by one level after assembly of the over next side shoring level very quickly and easily. This enables realization of a advancing side protection and avoiding overhead working steps.

In one preferable embodiment, a connection opening, particularly a hook-in-slot, is arranged at the mass plate preferably in an upper area and/or the mass plate provides a support arm for on the mass plate acting transmitting lifting and holding forces, which for example act on the deck through lifting or holding with a lifting and holding tool.

Having a connection opening arranged at the mass plate allows obtaining a self-acting locking of the lifting lock during insertion of a deck and a self-acting unlocking of the lifting lock simultaneously during lifting a deck. A very simple assembly and disassembly can thereby be achieved.

A mass plate with a support arm for transmitting on the mass plate acting lifting and holding forces enables a very high reliability and safety during application of the deck with lifting lock during operations. Furthermore, such supporting arm enables a very easy manual grasping (engaging) and thus unlocking of the lifting lock from below.

A further aspect of the application concerns a system comprising a separate lifting and holding tool and a deck, wherein the lifting and holding tool has a connection hook, which is designed such that it can be hooked, particularly hooked in a hinged manner (allowing pivoting), in an opening, particularly a hook-in-slot, of a deck or a lifting lock of a deck, and also allows extraction from the opening.

Having a lifting and holding tool with such a connection hook allows hooking of a deck and elevating it upwards by one level very quickly and in an ergonomic posture.

In contrast to deck elements with not detachable connected shoring struts according to document EP2557252A1, the present system has the advantage of very low weight of the decks, a very easy transportation through openings in the shoring as well as a very easy and fast assembly and disassembly.

In one preferable embodiment, the lifting and holding tool has a hang up hook for hanging up on a horizontal shoring strut, wherein the hang up hook is arranged at a position at the lifting and holding tool, such that when the lifting and holding tool is hanged up then a deck at one side being hooked in can be held at this side in a distance above an intended insertion position, particularly with a distance of at least 5 cm and/or at most 50 cm, preferably at most 20 cm.

A very easy assembly by means of swiveling up in a next higher shoring level of a deck without a blockade due to a horizontal shoring strut can herewith be achieved.

Having a deck according to document EP2557252A1, such a swiveling up in a next higher shoring level is only possible under abandonment of insertion hooks at one of both front sides of the deck. This is because the swiveling axis during swiveling up is in the plane of the intended insertion position.

As the swiveling point (axis) for swiveling up is shifted to above the plane of the intended insertion position, insertion hooks at both front side surfaces can be provided, which can result in a very high stability a robustness of the assembled decks.

In one preferable embodiment, the connection hook of the lifting and holding tool of the above described system is partly or mostly recessed and/or when the lifting and holding tool being hanged up then the connection hook extends slanting upwards towards a horizontal under an angle of at least 4 degree, preferably 8 degree, preferred 12 degree and/or at most 60 degree, preferably 50 degree, preferred 40 degree.

Recessed means that the connection hook is vaulted inwardly to the back, so that the hook ends protrude little over the lifting and holding tool.

Having a partly or mostly recessed connection hook as well as the slanting upwards extending embodiment of the connection hook a very easy insertion of the connection hook in an opening of a deck can be enabled. Furthermore, a very reliable and detaching-secured (-resistant) connection to the deck can be achieved also during swiveling in both directions.

In one preferable embodiment of the system, the lifting and holding tool is configured that during vertical position of the lifting and holding tool an in a hinged manner hooked in deck can be swiveled in a detaching-secured way for at least 80 degree, preferably 90 degree, preferred 110 degree in both directions Herewith, a deck can be at the same time held on the one side and be lifted up to the next higher level on the other side by means of the lifting and holding tool and thereby enabling a very simple and ergonomical assembly and disassembly. Additionally, if during assembly or disassembly the lifting and holding tool gets unintentionally detached at one side of the deck, the deck is still hold very reliably at the other side by the lifting and holding tool and thus prevents dropping down of the deck despite the sudden swiveling down of the deck. A very high work safety condition can thereby be achieved.

In one preferable embodiment of the system, an end of a rod forms a wide and flat connection hook and/or the lifting and holding tool comprises two rods that are arranged in parallel, which are connected through horizontal connection bars.

By forming an end of a rod as connection hook as well as by providing two rods in parallel with horizontal connection bars, a lifting and holding tool with very low weight and production expense can be provided. The connection bars can at the same time act as handles in special positions for a very easy assembly and disassembly.

A wide and flat connection hook as well as two rods—and thus two connection hooks—furthermore allow lifting and holding a deck in a very stably manner, i.e. without twisting and fluctuating.

In one preferable embodiment of the system, a hang up hook is directed towards the opposite direction of a connection hook and/or at least one connection rod is arranged in an upper area and one connection rod in a lower area of the lifting and holding tool.

Herewith, a very simple assembly and disassembly can be obtained.

A further aspect of the invention concerns a shoring tower with a deck particularly according to one of the above described embodiments, wherein the shoring tower is a load-bearing scaffold or support frame for shoring a beam for building a hall ceiling or a bridge and/or the shoring tower provides a head jack with adjustable spindle for shoring a beam or other components to be shored.

The features described in the introduction of the description, of the embodiments, of the figure description along with below described embodiments and examples as well as the features of the claims can be applied alone or also in variable combination with each other. The disclosure of the invention is thus not be limited to the described respectively claimed feature combinations. Rather, all feature combinations are regarded to be disclosed.

The invention is described in details in the following with figures schematically showing embodiment examples of a deck for a shoring tower and embodiments with references to the figures as well as further preferable embodiments.

It shows

FIG. 1: Deck with flap

Figure 2:
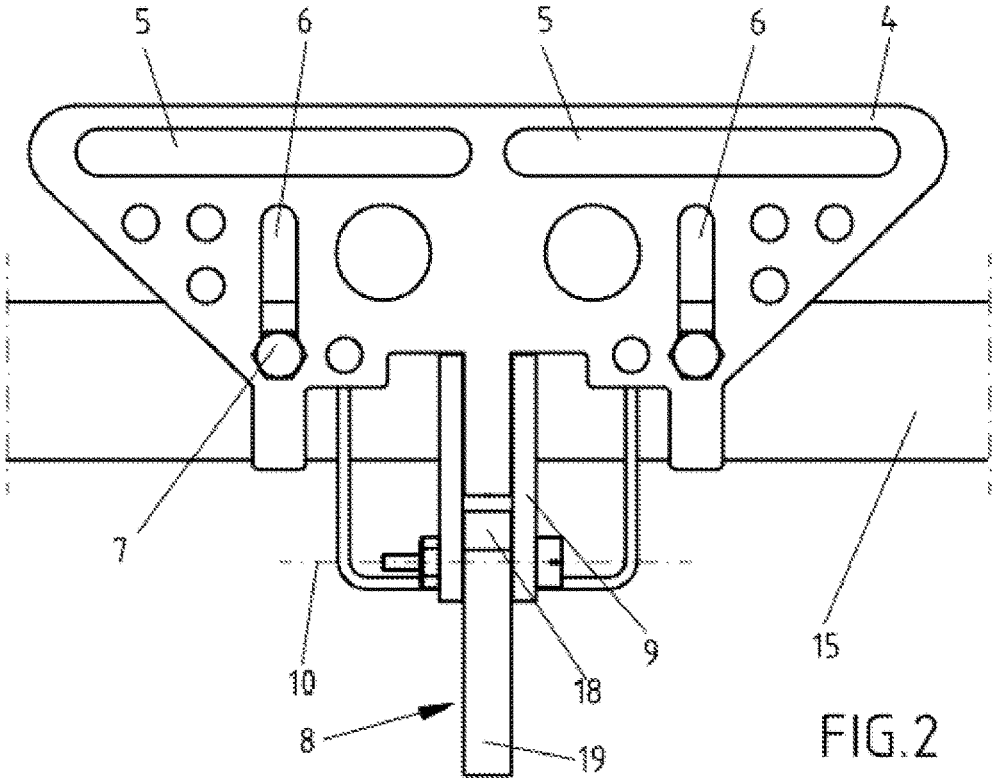

FIG. 2: Lifting lock in detached position

Figure 3:
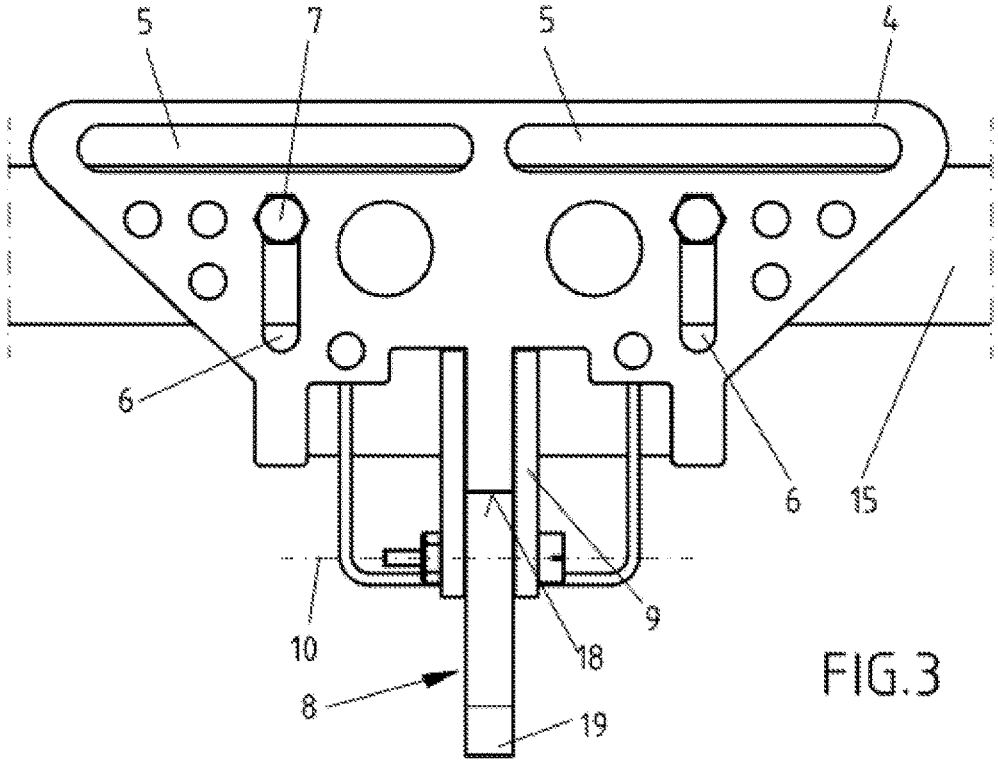

FIG. 3: Lifting lock in locked position

Figure 4:
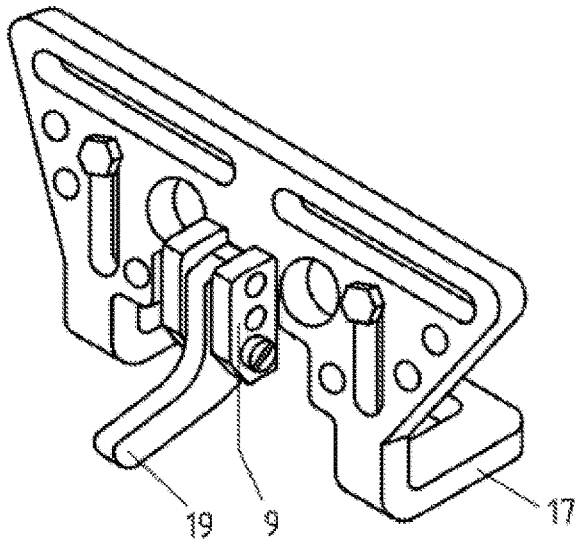

FIG. 4: Lifting lock in locked position

Figure 5:
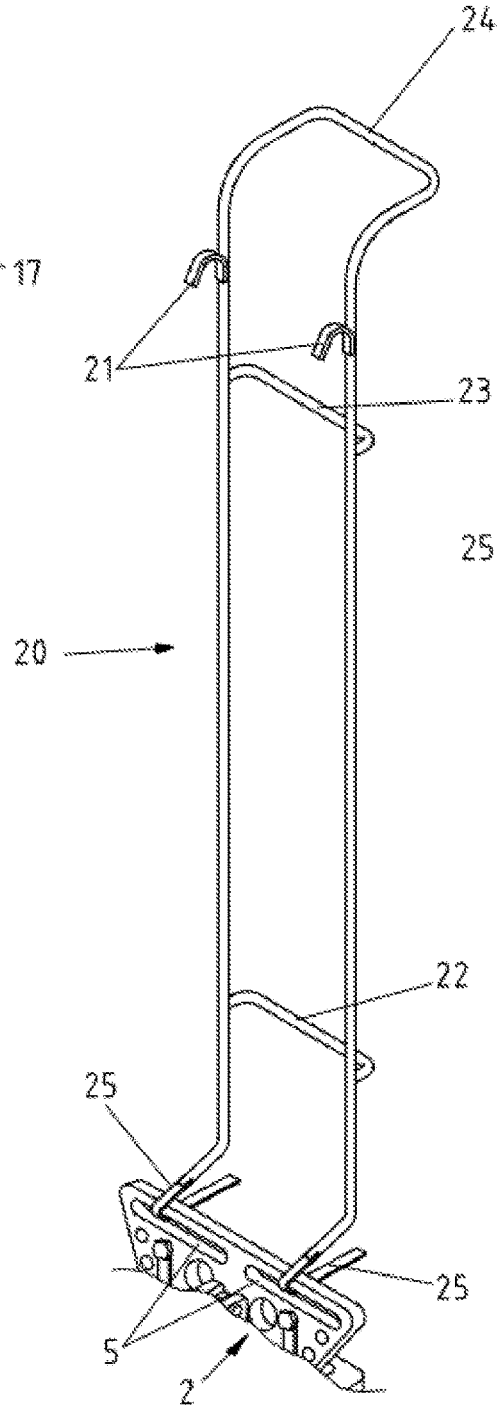

FIG. 5: Lifting and holding tool that is hooked in a hinged manner

Figure 6:
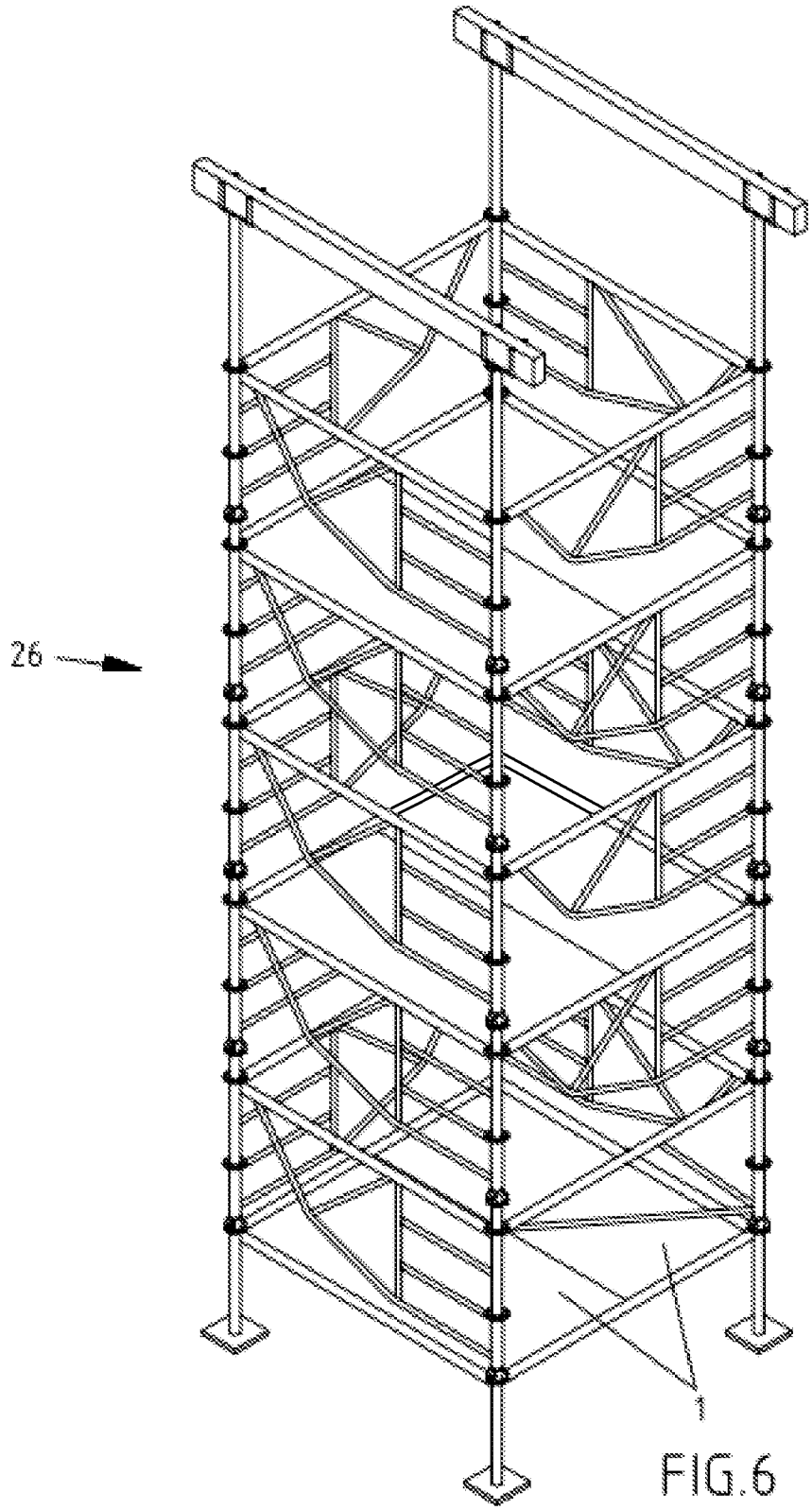

FIG. 6: Shoring tower

The FIG. 1 shows a deck 1 for forming an accessible area in a shoring tower 26, which can be used for fabrication or reconstruction of buildings A lifting lock 2 for avoiding taking off of the deck 1 from an intended insertion position is arranged particularly centered at a front side or both front sides of the deck 1, preferably centered between two insertion hooks 2 for hooking of the deck in a horizontal shoring strut.

A surrounding deck frame 15 made of metal for mounting a deck plate 12 enables a deck with a very high stability and strength. Particularly, a side profile 16 is arranged on both long sides of the deck 1 at the bottom side of the deck frame 15 in order to obtain a very robust mounting surface in insertion position as well as improved stackability.

Particularly, insertion hooks 2 and/or a lifting lock 2 are directly mounted at a deck frame 15 in order to save space and to achieve very high stability and thus operational safety.

The insertion hooks 2 are preferably mounted on the deck very strongly and safe by means of a connection with a vertical extending side plate of the deck frame 15.

A shoring level (see FIG. 6) comprises usually exactly two decks 1 in order to enable a fast assembly and disassembly.

At least one of the decks 1 of a shoring level provides a flap 13 for climbing through the deck from above to downwards or below to upwards. Preferably, such a flap 13 comprises a handle hole 14 in the deck plate 12 for opening from below or above. For ensuring that the flap 13 is not unintentionally opening, a spring loaded latch with a ramp is commonly provided, which engages a latching connection with the deck frame 15 in a self-acting manner during closing as well as can be opened with an operating element that is arranged at the handle hole 14. Opening of the flap 13 is thus possible very easily from above and below.

The FIG. 2 shows a detailed view of the lifting lock 2 in detached position. A mass plate 4 of the lifting lock 2 provides an oblong hole 6 as vertical guide 6 and is mounted translationally (together with) by a screw 7, which is preferably connected to the deck frame 15. A fork-shaped suspension 9 with two slide bars complements, supports respectively relieves the translational mounting by means of the oblong hole 6 and the screw 7. The mass plate 4 and/or the insertion hooks 2 have weight reducing openings 11 in order to allow providing a deck 1 with very low weight.

When the mass plate 4 is hold against the force of gravity in an upper position (see FIG. 2), which is defined by an upper end stop of the oblong hole 6, i.e. in detached position of the lifting lock 2, a L-shaped latch 8 can pivot freely about an latch rotation axis 10 that is oriented in parallel to a horizontal shoring strut.

A commonly U-shaped support arm 17 (see FIG. 4) is arranged at the bottom side of the mass plate 4, preferably being one piece with the mass plate 4 and/or extending orthogonally towards a motion path of the mass plate 4. Therewith, lifting and holding forces can be transmitted very easily and reliably to the deck 1 respectively the deck frame 15 and/or deck plate 12 during lifting or holding of the deck 1 above the lifting lock 2 respectively the mass plate 4 of the lifting lock 2. Otherwise, these forces would be born (absorbed) only by the screw 7. Furthermore, the lifting lock 2 can thus be unlocked very easily during assembly and disassembly through pushing the support arm 17 upwards.

When the mass plate 4 is released, it will fall by forces of gravity in the lower position (see FIG. 3), which is defined by an upper end stop of the oblong hole 6. The latch 8 is thereby rotated by means of the down moving mass plate 4 until the mass plate is planar adjacent (in direct contact) to an upper latch arm 18 and thus blocking it from rotation. The lifting lock 2 is then in locked position (FIGS. 3 and 4). At the front side of the deck, the lower latch arm 19 protrudes in locked position such that the lower latch arm 19 can reaching under a horizontal shoring strut for locking the lifting lock 2.

The L-shaped latch 8 can be designed such way that the L-shaped latch 8 works as catch, which is pivotable about the latch rotation axis 10 and whose rotation axis is arranged in the turning area between an upper latch arm 18 and a lower latch arm 19 that is connected to the upper latch arm 18 under an angle. The lower latch arm 19 is substantially as long as the upper latch arm 18 at equal thickness. In detached position of the lifting lock, the lower latch arm 19 rotates through force of gravity downwards and the upper latch arm 18 protrudes above that a little or at least more than the lower latch arm 19.

When the deck 1 is let down in detached position (FIG. 2) in direction towards the intended insertion position, at least the lower latch arm 19 passes by a horizontal shoring strut. However, the upper latch arm 18 can be already due to its protrusion be pushed upwards by the horizontal shoring strut. By means of a releasing of letting down the mass plate 4, a rotation of the latch 8 respectively the catch can be accomplished in every case such that the lifting lock 2 and thus the deck 1 is secured reliably against unintentionally taking off by means of locking with the horizontal shoring strut.

In order to enable a very easy lifting and holding of the deck 1 through the lifting lock 2 respectively the mass plate 4 of the lifting lock 2, the mass plate 4 has two hook-in-slots 5 for hooking in a hinged manner of a separate lifting and holding tool 20.

The FIG. 5 shows a lifting and holding tool 20 with two connection hooks 25 for hooking in the hook-in-slots 5 of the mass plate 4 a hinged manner. Particularly, also two hang up hooks 21 are provided for hanging up the lifting and holding tool 20 on a shoring strut.

Because the connection hooks 25 are designed mostly recessed and extending slanting upwards under an angle towards a horizontal in vertical position of the lifting and holding tool 20 (as shown in FIG. 5), the lifting and holding tool 20 can be inserted very easily in the hook-in-slots 5 of the mass plate 4 in locked position of a deck 1 being placed in an intended insertion position as the lifting and holding tool 20 after dropping (being placed) on the horizontal shoring strut can be pushed in direction towards the deck 1.

When the deck 1 is lifted through the lifting and holding tool 20, the deck 1 is simultaneously secured by the hooked in a hinged manner connection against detaching also in case of unintentionally releasing and falling down of one side of the deck 1.

The lifting and holding tool 20 has two in parallel arranged rods, which are connected through horizontal connection bars 20, 23, 24. The horizontal connection bars 20, 23, 24 are further arranged and designed such that they form at the same time an lower handle 22, middle handle 23 and upper handle 24. By that way, assembly and disassembly under usage of the holding and lifting tool 20 is possible that enables a very easy, ergonomical and effort-saving assembly and disassembly.

FIG. 6 shows an embodiment of a shoring tower 26 with a deck 1, wherein the shoring tower 26 is a load-bearing scaffold or support frame for shoring a beam for building a variable supporting structure and/or provides a head jack at the upper area, particularly fork-shaped head jack, with adjustable spindle for shoring a beam or other components to be shored.

The invention claimed is:

1. A system comprising a separate lifting and holding tool (20) and a deck (1) for forming an accessible area in a shoring tower (26), wherein the lifting and holding tool (20) has a connection hook (25), which is designed such that the connection hook (25) is hooked in a hinged manner in a hook-in-slot (5) formed in one of the deck (1) and a lifting lock (2) of the deck (1), and such that it also allows extraction from the hook-in-slot (5) wherein the lifting and holding tool (20) has a hang up hook (21) for hanging up on a horizontal shoring strut, wherein an end the connection hook (25) extends horizontally in an opposite direction from the hang up hook (21), where the end of the connection hook has a wide and flat shape to prevent twisting, and the lifting and holding tool (20) comprises two rods that are arranged in parallel, which are connected through horizontal connection bars (22, 23, 24).

2. The system of claim 1, wherein the hang up hook (21) is arranged at a position along the lifting and holding tool (20) such that when the lifting and holding tool (20) is hanged up by the hang up hook (21) being coupled to a horizontal shoring strut and when the deck (1) is also hanged up by the connection hook (25) being coupled to the hook-in-slot (5) then one side of the deck (1) is held a distance above an intended insertion position with a distance of at least 5 cm and at most 50 cm from an associated horizontal shoring strut.

3. The system of claim 1, wherein the lifting and holding tool (20) is configured to be mounted for rotation about an axis spaced apart from the connection hook (25) such that when the holding tool 20 is arranged in a vertical position and is, in a hinged manner hooked in the deck (1), the lifting and holding tool (20) can be swiveled about the axis for at least 80 degrees in both directions before the connection hook will be detached from the deck (1).

4. The system of claim 1, wherein a hang up hook (21) is directed towards an opposite direction of the connection hook (25) and at least one connection rod (23, 24) is arranged in an upper area and one connection rod (23, 24) in a lower area of the lifting and holding tool (20).

5. The system of claim 1, wherein the holding tool (20) includes horizontal connection bars that are arranged to form a lower handle (22), a middle handle (23) and an upper handle (24).

6. The system of claim 1, wherein the deck (1) forms an accessible area in the shoring tower (26), which can be used for fabrication or reconstruction of buildings, wherein the lifting lock (2) is configured to switch from a detached position into a locked position only by force of gravity, and wherein the lifting lock (2) is configured to switch from the locked position into the detached position in response to lifting of the deck (1) through engagement of the lifting lock (2) by connection hook (25) of the holding tool (20).

7. The deck of claim 6, wherein the lifting lock (2) comprises a mass plate (4), which is translationally mounted by means of a vertical guide (6, 7) or by means of a screw (7) guided in an oblong hole (6).

8. The deck of claim 6, wherein the lifting lock (2) comprises a catch for locking the deck (1) with a horizontal shoring strut.

9. The deck of claim 6, wherein a catch of the lifting lock (2) is formed by an L-shaped latch (8), which is configured to be pivoted about a latch rotation axis (10) that is oriented in parallel to a horizontal shoring strut.

10. The deck of claim 6, wherein a latch rotation axis (10) is arranged in an area between an upper latch arm (18) and a lower latch arm (19), wherein the upper latch arm (18) and the lower latch arm (19) confine an angle.

11. The deck of claim 6, wherein in the locked position of the lifting lock (2) a lower latch arm (19) protrudes for reaching under a horizontal shoring strut for locking the lifting lock (2) and a mass plate (4) is arranged planar adjacent to an upper latch arm (18) to block a rotation of the upper latch arm (18).

12. The deck of claim 6, wherein the lifting lock (2) in configured such that when a mass plate (4) included in the lifting lock is released, it will fall by forces of gravity in a lower position, so that a latch (8) is thereby rotated by means of the down moving mass plate (4) until the mass plate (4) is planar adjacent to an upper latch arm (18) of the latch (8) and thus blocking it from rotation, so that the lifting lock (2) is then in locked position.

13. The deck of claim 6, wherein the lifting lock (2) includes a latch (8) mounted for rotation about a latch rotation axis (10) and a suspension (9) configured to support the latch (8) is passed through by the latch rotation axis (10), and wherein the suspension (9) is fork-shaped and provides a sliding surface for a mass plate (4) also included in the lifting lock (2).

14. The deck of claim 6, wherein a lower latch arm (19) included in a latch (8) of in the lifting lock (2) is substantially as long as an upper latch arm (18) included in a latch (8) of in the lifting lock (2).

15. The deck of claim 6, wherein the lifting lock (2) provides the hook-in-slot (5) for hooking in of the separate lifting and holding tool (20).

16. The deck of claim 6, wherein the hook-in-slot (5) is arranged in a mass plate (4) included in the lifting lock (2) and allows extraction of the separate lifting and holding tool (20).

17. The deck of claim 6, wherein a mass plate (4) provides a support arm (17) for transmitting lifting and holding forces that act on the mass plate (4).

18. The deck of claim 6, wherein the lifting lock (2) is arranged centered at a front side of the deck (1) and centered between two insertion hooks (2).

19. A system comprising a plurality of horizontal struts, a deck selectively attached and detached from at least one of the plurality of horizontal struts, a lifting lock coupled to the deck, the lifting lock including a mass plate having at least one hook-in-slot formed therethrough and a latch selectively block detachment of the deck from the at least one of the plurality of horizontal struts, and a lifting and holding tool adapted for use in the attachment and detachment of the deck, the lifting and holding tool comprising a pair of parallel rods that each have a connection hook at one end, a plurality of horizontal connection bars that extend between the pair of parallel rods to provide handles for a user holding the lifting and holding tool, and pair of hang up hooks spaced apart from the connection hooks that are each coupled to a corresponding one of the pair of parallel rods, wherein the connection hooks are removably arranged in the at least one hook-in-slot of the mass plate included in the lifting lock, the pair of hang up hooks receive one of the plurality of horizontal struts to establish a pivot axis along the horizontal strut received by the pair of hang up hooks about which the lifting and holding tool swivels relative to the plurality of horizontal struts, and the connection hooks slide out of the at least one hook-in-slot in response to swiveling motion of the lifting and holding tool about the pivot axis away from deck and the lifting lock.

* * * * *